US007775183B2

(12) United States Patent
Green

(10) Patent No.: US 7,775,183 B2
(45) Date of Patent: Aug. 17, 2010

(54) ELECTRONIC VOLTAGE REMOVER

(75) Inventor: Michael Philip Green, Pleasant Hill, CA (US)

(73) Assignee: Vehicle Enhancement Labs, Bellflower, CA (US)

( * ) Notice: Subject to any disclaimer, the term of this patent is extended or adjusted under 35 U.S.C. 154(b) by 336 days.

(21) Appl. No.: 11/318,941

(22) Filed: Dec. 27, 2005

(65) Prior Publication Data

US 2007/0144462 A1 Jun. 28, 2007

(51) Int. Cl.
*F01P 5/14* (2006.01)

(52) U.S. Cl. ..... 123/41.15; 123/198 D

(58) Field of Classification Search ..... 123/41.15, 123/198 D

See application file for complete search history.

(56) References Cited

U.S. PATENT DOCUMENTS 4,000,726 A * 1/1977 Simon ..... 123/529
5,426,347 A * 6/1995 Nilssen ..... 315/209 R
5,898,560 A * 4/1999 Flaynik et al. ..... 361/215
5,972,531 A * 10/1999 Kawakami ..... 429/49
6,168,713 B1 * 1/2001 Sekine et al. ..... 210/172.3
6,740,236 B2 * 5/2004 Rickle et al. ..... 210/243
6,762,584 B2 * 7/2004 Harvey ..... 320/107
2005/0014036 A1 * 1/2005 Kim ..... 429/7
2005/0153195 A1 * 7/2005 Han ..... 429/59
2005/0258954 A1 * 11/2005 Ruskin ..... 340/527
2008/0176131 A1 * 7/2008 Byun et al. ..... 429/122

FOREIGN PATENT DOCUMENTS

JP 2000-357615 * 12/2000

* cited by examiner

*Primary Examiner*—Hai H Huynh
(74) *Attorney, Agent, or Firm*—Novak Druce & Quigg LLP

(57) ABSTRACT

The present invention removes voltage that accumulates over a period of time in an automotive engine cooling system. This accumulation of voltage is provided a path to travel inside the engine and cooling system by the cooling liquid used to cool the vehicles engine. This accumulation of voltage looks for a likable metal to bond with and the constant colliding of the voltage trying to bond with the metal creates damage know as electrolytic metal erosion. Overtime this act of nature erodes and weakens metal cooling system components causing them to fail. This process can lead to the vehicle breaking down due to its engine overheating. The electronic voltage remover is designed to remove and dissipate this harmful voltage from the vehicle's engine cooling system.

7 Claims, 3 Drawing Sheets

ELECTRONIC VOLTAGE REMOVER

BACKGROUND OF INVENTION

This invention pertains to automotive engine cooling systems and the removal of electrical energy that routinely accumulates in the vehicle's cooling system. It has been determined that electrical voltage over 0.300 milli volts can cause serious damage to cooling system components in contact with the vehicle's engine cooling liquid. This voltage is generated by several sources such as static electricity from tires as they rotate, short circuits in the vehicles electrical systems or dissimilar metals inside the cooling system that create electrical energy. This electrical energy, if not removed, can develop and cause electrolysis. Electrolysis is a positive electrical energy bonding with a negative metal source. Over a period of time the constant colliding or the two energies cause metal erosion eventually weakening it and causing the metal to fail. In an automotive cooling system, electrolysis erosion causes softer metals located in the internal passage ways of the engine and other cooling system components to develop leaks and allowing engine cooling liquid to escape the system which can cause the vehicle's engine to overheat. In some cases serious damage to the engine can occur. The electronic voltage remover when installed on a vehicle removes accumulated electricity from the cooling system helping to prevent the electrolysis process.

BRIEF SUMMARY OF THE INVENTION

The present invention removes harmful electrical voltage from inside an automotive engine cooling system that overtime can cause serious engine and cooling system component failure. Most vehicle cooling system metal components will conduct either a positive or negative voltage when in contact with the cooling system liquid. When two components in the system are located through voltage testing and one shows positive voltage and the other shows negative voltage, an electrical circuit can be completed by connecting the two together. The present invention having two wire leads, one positive and one negative connects to a battery box which houses a rechargeable type nickel-metal hydride battery. A nickel-metal hydride battery stores electrical energy and is rechargeable as the stored electrical energy is depleted. When attaching a very low resistance voltage light bulb to the battery creates a slow drainage and constantly keeps the battery searching for replaceable voltage. When the individual wire leads from the battery box are attached to a positive and negative metal cooling system component a circuit is completed and allows the nickel-metal hydride battery to continuously collect both positive and negative voltage trying to recharge itself from the vehicle's cooling system. This constant collecting of electrical energy keeps the vehicle's cooling system at a save voltage limit and slows or in some cases eliminates the electrolytic metal erosion process.

DETAILED DESCRIPTION OF THE DRAWINGS

Figure 1:
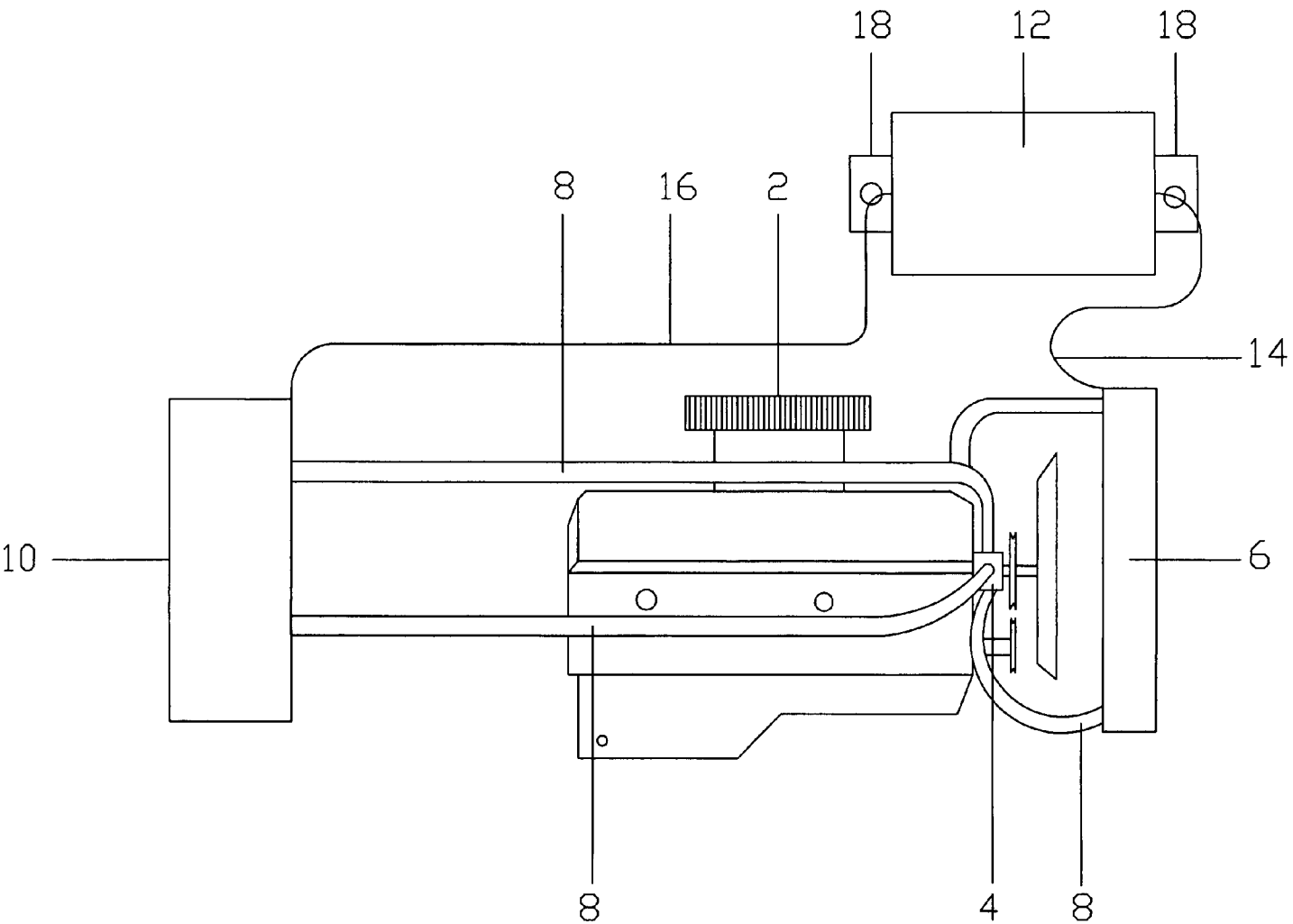
FIG. 1 illustrates the perspective side view of related art to the present invention.

FIG. 1 illustrates the related art of the present invention, the vehicle's engine 2 depends on a cooling system liquid which is circulated by a liquid pump 4 to a heat exchange system more commonly known as a radiator 6 and is used to transfer heat out of the cooling system liquid. The re-circulating cooling system liquid is provided a path to travel to external cooling system components by a series of hoses or tubes 8. External components such as the heater core 10 depend on the heated cooling system liquid from the vehicle's engine to product heat to heat the inside of the vehicle. Most external heat exchanging components such as the heater core 10 and the radiator 6 are made from aluminum allowing for greater and quicker heat dissipation but being made of a softer metal it is more susceptible to electrolytic metal erosion caused by electrolysis. The present invention, the electronic voltage remover 12 when connected to a positive voltage tested cooling system component such as a heater core 10, uses the positive lead wire 16 to connect the two components together. A negative voltage tested component such as the radiator 6, uses the negative lead wire 14 to connect the two components together. This completes an electrical circuit and allows the electronic voltage remover 12 to draw electrical voltage out of the vehicle's cooling system liquid. A series of mounting brackets 18 allow permanent mounting of the voltage remover 12 to the vehicle.

Figure 2:
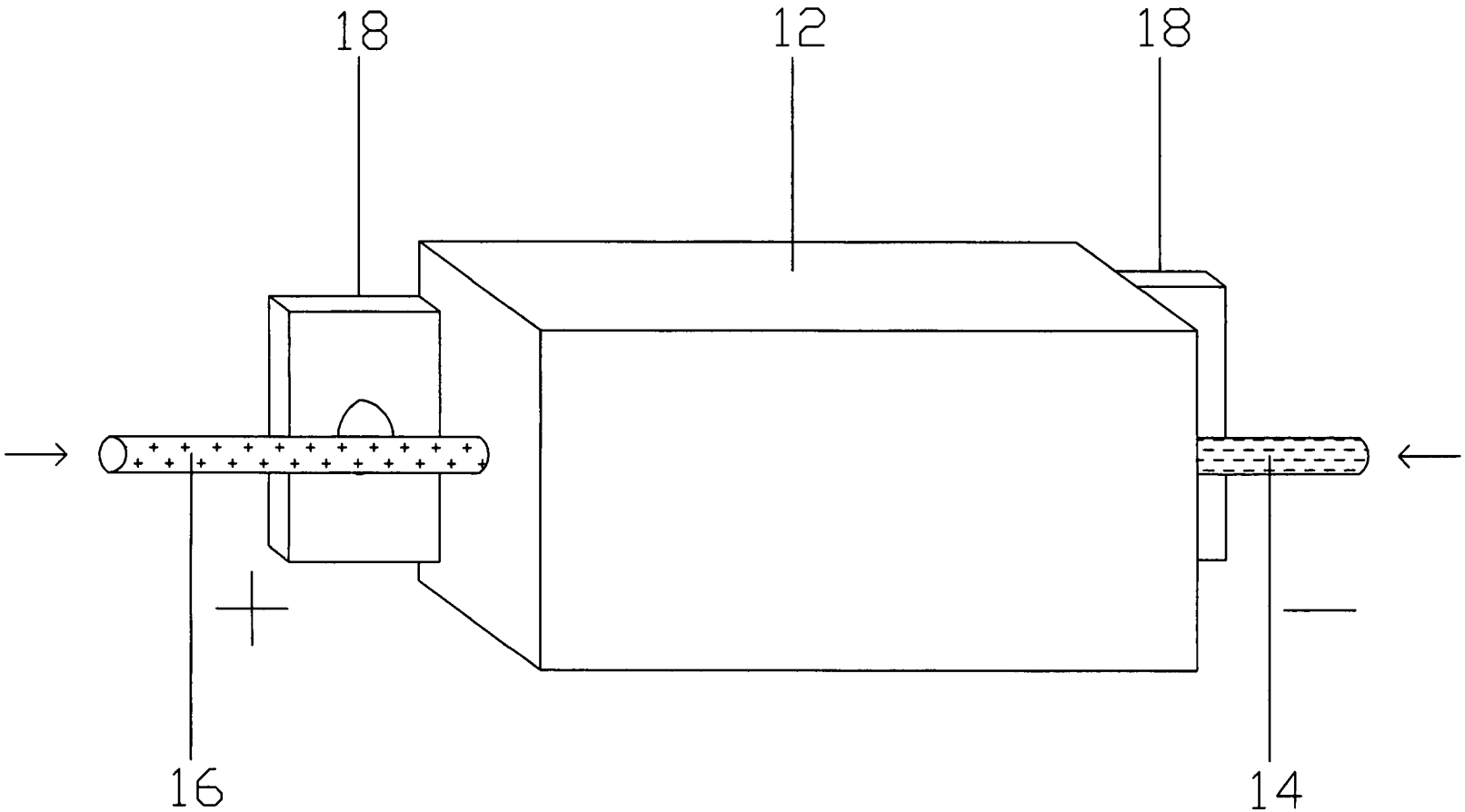
FIG. 2 illustrates the operational flow of voltage to the present invention.

FIG. 2 illustrates a phantom view of the operational flow of the cooling system voltage flowing to the electronic voltage remover 12. When the positive wire 16 is connected to a positive voltage cooling system metal component source and the negative wire 14 is connected to a negative cooling system metal component source allows completion of an electrical circuit and allows voltage to flow from the vehicles cooling system to the electronic voltage remover 12. The electronic voltage remover 12 is mounted to the vehicle by a series of mounting brackets 18.

Figure 3:
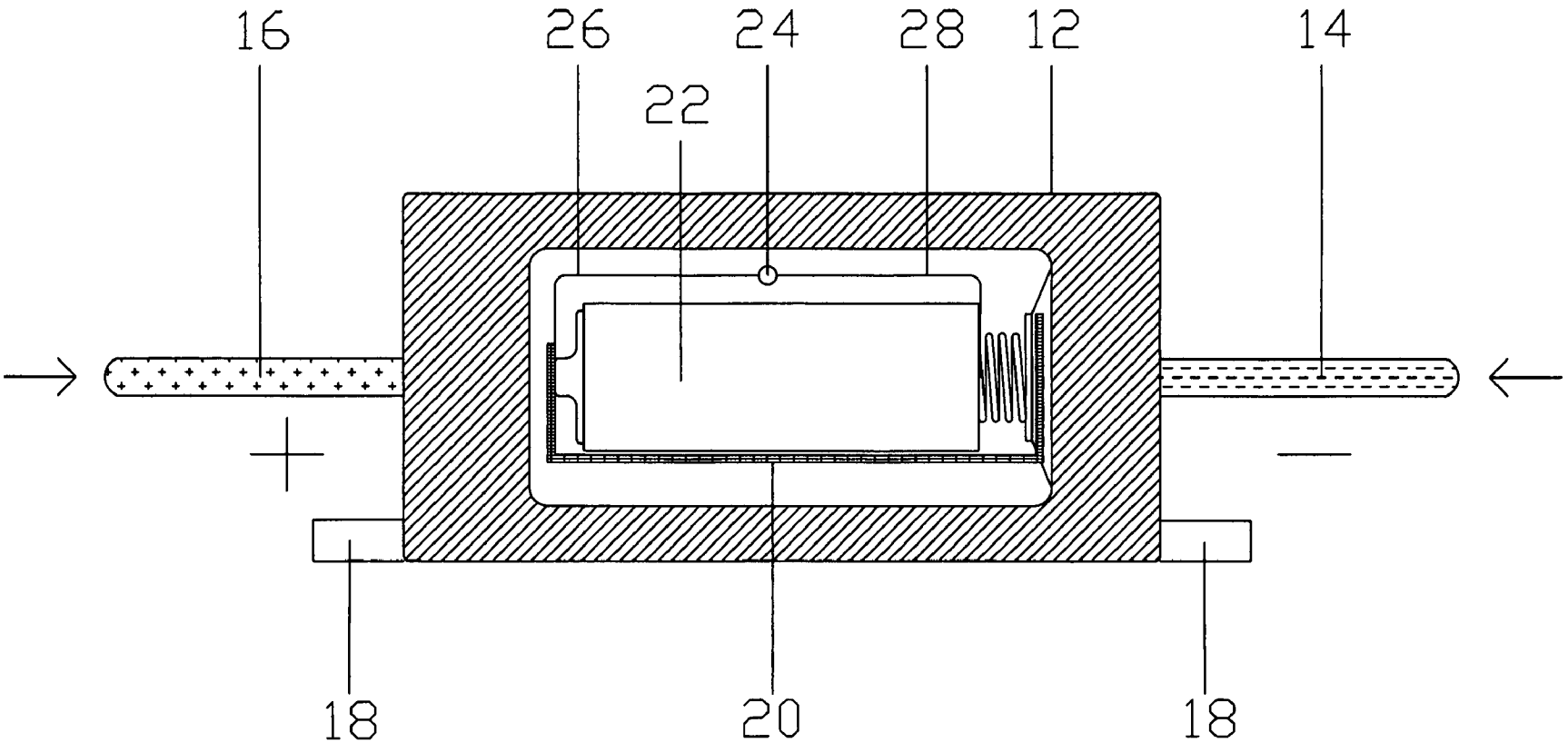
FIG. 3 illustrates a detailed cut away drawing of the present invention.

FIG. 3 illustrates a detailed cut away view of the present invention. Mounting brackets 18 allow permanent hold downs for the electronic voltage remover 12 to the vehicle. The electronic voltage remover 12, through the cut away view, shows a battery box housing 20, the rechargeable type nickel-metal hydride battery 22 and the low resistance voltage light bulb 24. A positive lead wire 16 connects to the positive post of the battery box housing 20 while the other end of the wire 16 connects to a positive tested voltage cooling system component. The negative wire 14 connects to the negative post of the battery box housing 20 while the other end of the wire 14 connects to a negative tested voltage cooling system component. The low resistance voltage light bulb 24 having both a positive wire lead 26 and negative wire lead 28 is connected appropriately to the battery 22 which continuously put a low voltage draw on it. Once the appropriate connections are made to the vehicle's cooling system the rechargeable type nickel-metal hydride battery 22 searches and attracts electrical voltage from the vehicle's cooling system. As the battery 22 collects the voltage from the vehicle's cooling system the reduction of voltage keeps the cooling system save from electrolytic metal erosion.

While various modifications, changes and alternatives are suggestible to one skilled in the art based on the descriptions set forth above, the invention is to be given the broadest interpretation based on the scope of the appended claims.

What is claimed is:

1. An electronic DC voltage remover used for the purpose of removing electrical voltage from an automotive cooling system comprising the following:

a rechargeable nickel-metal hydride battery housed inside a battery holder, with said battery holder having a direct connection to the positive and negative battery terminals and with said battery holder having a provision for external positive and negative electrical connections, said positive electrical connection for mounting to an electronically positive component of the automotive cooling system and said negative electrical connection for mounting to an electronically negative component of said cooling system being connected to the positive and negative electrical connections, respectively.

2. The voltage remover of claim 1, further comprising a low voltage light bulb having a positive and negative electrical connection to the battery holder.

3. The voltage remover of claim 1, further comprising a protective housing for mounting the electronic DC voltage remover.

4. The voltage remover of claim 1, wherein said external positive connection is connected to a heater core of the automotive cooling system.

5. The voltage remover of claim 1, wherein said external negative connection is connected to a radiator of the automotive cooling system.

6. The voltage remover of claim 4, wherein said external negative connection is connected to a radiator of the automotive cooling system.

7. An electronic voltage remover used to remove electrical voltage that can cause damage to a vehicle's engine cooling system, uses a rechargeable nickel-metal hydride battery, housed in a common battery holder located inside a protective housing and utilizes a low voltage light bulb used to deplete the battery of power, and a positive and negative wire lead connected to the battery holder used for connection to a low voltage positive and negative power source used to draw voltage from the system which provide recharging for the battery.

* * * * *